US005939820A

United States Patent [19]

Jo

[11] Patent Number: 5,939,820

[45] **Date of Patent: *Aug. 17, 1999**

[54] ELECTRON GUN WITH FOCUSING ELECTRODE HAVING A CURVED SURFACE

[75] Inventor: Sung-Ho Jo, Seoul, Rep. of Korea

[73] Assignee: LG Electronics Inc., Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/677,846

[22] Filed: Jul. 10, 1996

[30] Foreign Application Priority Data

Jul. 28, 1995 [KR] Rep. of Korea ..... 95-22935

[51] Int. Cl.[6] ..... H01J 29/51; H01J 29/58

[52] U.S. Cl. ..... 313/449; 313/414

[58] Field of Search ..... 313/414, 412, 313/452, 449; 315/382.1, 15, 16

[56] References Cited

U.S. PATENT DOCUMENTS

| | | | |
|---|---|---|---|
| 3,772,554 | 11/1973 | Hughes | 313/414 |
| 4,310,780 | 1/1982 | Sakurai et al. | 313/412 |
| 4,701,678 | 10/1987 | Blacker et al. | 313/412 |
| 4,731,563 | 3/1988 | Bloom et al. | 313/414 |
| 4,940,917 | 7/1990 | Stil | 313/414 |
| 5,038,073 | 8/1991 | Son | 313/414 |
| 5,170,101 | 12/1992 | Gorski et al. | 313/412 |
| 5,198,719 | 3/1993 | Koh | 313/414 |

*Primary Examiner*—Sandra O'Shea
*Assistant Examiner*—Michael Day

[57] ABSTRACT

An electron gun for a color cathode ray tube includes a cathode, a triode portion having control and accelerating electrodes, a pre-focus lens formed by a first accelerating/focusing electrode, a second accelerating/focusing electrode, and a third accelerating/focusing electrode, and a main lens formed by the third accelerating/focusing electrode and a fourth accelerating/focusing electrode, wherein outer lens elements of the pre-focus lens and the main lens are inclined so as to prevent formation of halos.

10 Claims, 7 Drawing Sheets

ELECTRON GUN WITH FOCUSING ELECTRODE HAVING A CURVED SURFACE

BACKGROUND OF THE INVENTION

The present invention relates to an electron gun for a color cathode ray tube, and more particularly, to an electron gun for a color cathode ray tube for passing an outer electron beam through the center of an outer main lens to thereby prevent distorted halo caused by the one-sided concentration of the electron beam.

As shown in FIG. 1, in a general cathode ray tube, electrodes are placed perpendicular to the path of an electron beam, so that electron beams 13, 14 and 15 generated from three cathodes 3 have a predetermined intensity and collide against a screen 17 via a shadow mask 16 in order to emit light. A control electrode 4, an accelerating electrode 5 spaced apart from the control electrode 4 by a predetermined distance, and first through fourth accelerating/focusing electrodes 6, 7, 8 and 9 are positioned in the cathode ray tube.

When a heater 2 built in the cathode 3 is heated by receiving power from a stem pin 1, thermions emitted from the cathode 3 due to the heat. Then the thermions are controlled by the control electrode 4, and are accelerated by the accelerating electrode 5. The diverging angle of the electron beams is reduced by the first, second and third accelerating/focusing electrodes 6, 7 and 8, which form a pre-focus lens. The electron beams are converged and accelerated by the third and fourth accelerating/focusing electrodes 8 and 9, which form a main lens. Then, the electron beams pass through the shadow mask 16 placed in front of the phosphorous surfaced screen 17 and collide with the screen 17 to emit light.

FIG. 2 shows the structure of a large-diameter main lens for an electron gun. The diameter of the main lens increases in order to reduce spherical aberration for the main lens portion. Track-shaped rims 18 and 19, which are common for the red R, green G and blue B electron beams, are formed on the facing surfaces of third and fourth accelerating/focusing electrodes 8 and 9. Electric-field control electrodes 20 and 21 are installed behind the rims 18 and 19 by a predetermined distance.

The diameter of the main lens formed as in FIG. 3 may be increased by varying the position of electrodes 18 and 19. However, as shown in FIGS. 4A and 4B, the converging degree of outer beams 13" and 15" advancing in the direction of central beam 14 becomes greater than that of the outer beams 13' and 15' advancing in the opposite direction of the central beam 14. For this reason, halos 24 and 25 appear on the screen 17 from the outer electron beams 213 and 215, as shown in FIG. 6A. In FIGS. 4A–5B, the X-axis represents the distance between the cathode and screen and the Y-axis represents the amount of outer beam focused on the center beam.

FIGS. 15A and 15B show patterns of lenses produced by the electron gun. Particularly, FIG. 15A shows a case where the centers of main lenses 220 and 23 are positioned outside of outer beams. FIG. 15B shows a case where the centers of the main lenses 220 and 23 are positioned between the outer beams. In case of FIG. 15B, the converging degree of the outer electron beams and their spot shapes on the screen 17 are shown in FIGS. 4A, 4B and 6A. The case of FIG. 15A has characteristics opposite to the case of FIG. 15B. In FIGS. 15A and 15B, the reference numeral 43 represents conventional triode auxiliary lenses, and the reference numeral 44 represents conventional outer and center pre-focus lenses.

As explained above, in order to reduce spherical aberration, the diameter of the main lenses is increased so that the center of the outer electron beams deviates from that of the outer main lenses. This differentiates the converging degrees of the electron beams passing through the main lenses in the direction of the central electron beam and in the direction opposite thereto. Accordingly, the electron beam on the screen in is shaped so that a halo is formed on one side, which deteriorates the focusing characteristic of the outer beam and the resolution of the screen 17. Further, the conventional electron gun cannot simultaneously satisfy the balanced converging degree of the three electron beams and the difference in the converging degree of the horizontal and vertical electron beams.

SUMMARY OF THE INVENTION

Therefore, it is an object of the present invention to provide an electron gun for a color cathode ray tube in which a pre-focus lens is inclined toward the center direction of the outer main lens so as to prevent the center of outer electron beams from deviating from the center of the outer main lens of a large-diameter main lens, which reduces formation of distorted halos caused by which one-sided concentration of the electron beam and which increases the resolution of the screen by controlling the intensity of the STC phenomenon.

To accomplish the above and other objects of the present invention, there is provided an electron gun for a color cathode ray tube, comprising a cathode for emitting an electron beam, a triode portion having control and accelerating electrodes for controlling the emission amount of the electron beam and forming a crossover, a pre-focus lens formed by a first accelerating/focusing electrode, second focusing electrode, and third accelerating/focusing electrode for auxiliarily converging the electron beam, and a main lens formed by the third accelerating/focusing electrode and fourth accelerating/focusing electrode for converging the electron beam on a screen, wherein the pre-focus lens is formed to be inclined toward the direction of center of electron beam passing axis of an outer main lens so that outer electron beams pass through the center of the outer main lens formed on both sides of a central main lens of a large-diameter main lens.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE ATTACHED DRAWINGS

The present invention will become more fully understood from the detailed description given hereinbelow and the accompanying drawings which are given by way of illustration only, and thus are not limitative of the present invention and wherein.

DETAILED DESCRIPTION OF PREFERRED EMBODIMENTS

Hereinafter, preferred embodiments of the present invention will be described with reference to the attached drawings.

Figure 7:
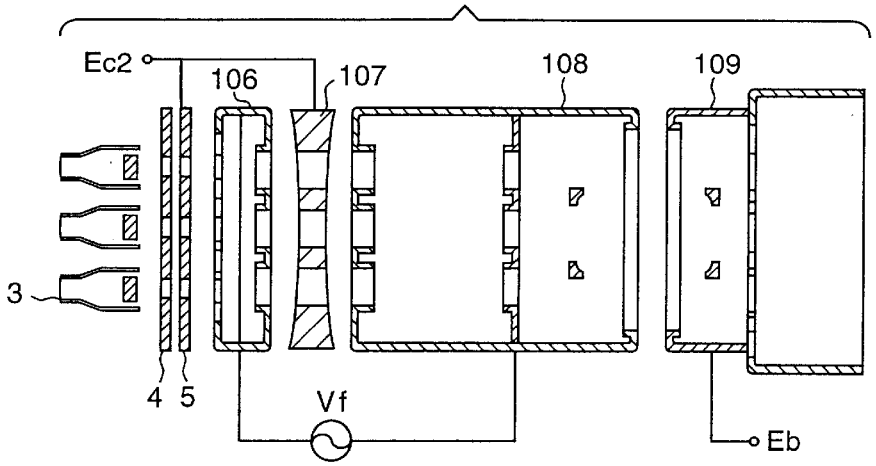
FIG. 7 illustrates an electron gun for a color cathode ray tube according to a first embodiment of the present invention.

Referring to FIG. 7, an electron gun according to the first embodiment of the present invention includes a plurality of cathodes 3 for emitting electron beams, a triode portion having a control electrode 4 and an accelerating electrode 5 for controlling the emission amount of the electron beams and forming a crossover, a pre-focus lens having first and third accelerating/focusing (accelerating and focusing) electrodes 106 and 108 for auxiliarily focusing the electron beams, a second focusing electrode 107, and the third and fourth accelerating/focusing (accelerating and focusing) electrodes 108 and 109 for forming a main lens which converges the electron beams on a screen. With this configuration, the second accelerating/focusing electrode 107 has a thickness increasing from its central beam passing hole to its outer beam passing hole. The voltage Ec2 of accelerating electrode 5 is applied to the second focusing electrode 107, and focus voltage Vf is applied to the first and third accelerating/focusing electrodes 106 and 108.

Figure 8:
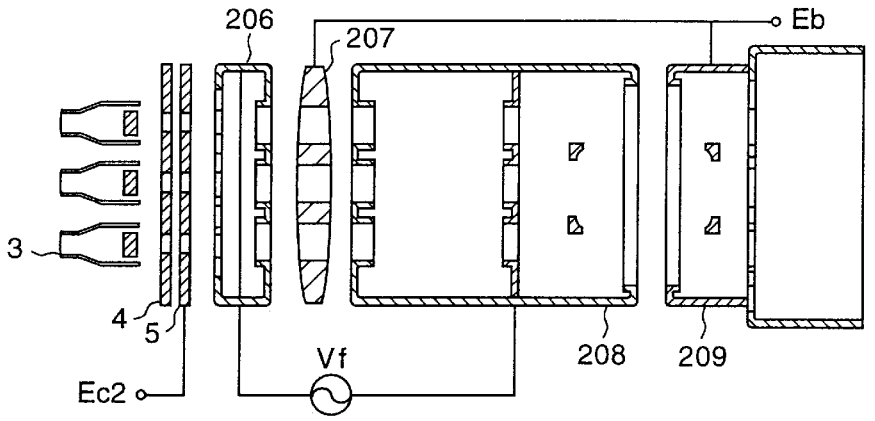
FIG. 8 illustrates an electron gun for a color cathode ray tube according to a second embodiment of the present invention.

In a second embodiment of the present invention as shown in, e.g. FIG. 8, the second focusing electrode 207 has from its central beam passing hole to its outer beam passing hole. The voltage Ec2 of accelerating electrode 5 is applied to the second focusing electrode 207, and focus voltage Vf is applied to the first and third accelerating/focusing electrodes 206 and 208. An anode voltage Eb is applied to the fourth electrode 209.

Figure 9:
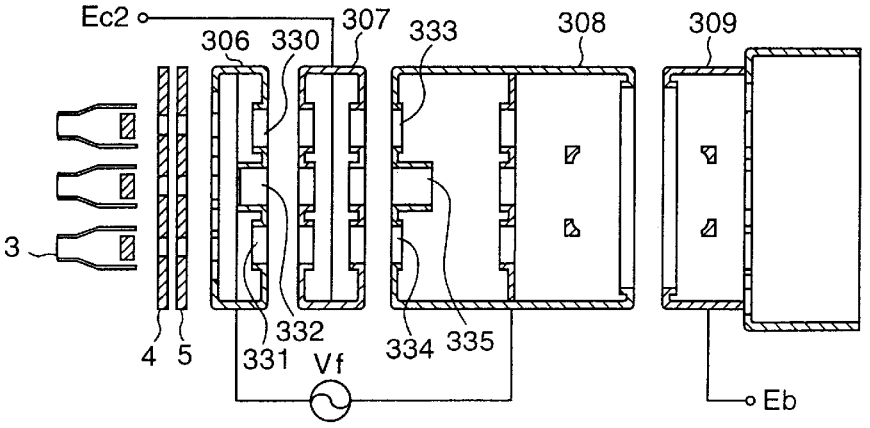
FIG. 9 illustrates an electron gun for a color cathode ray tube according to a third embodiment of the present invention.

Referring to FIG. 9 showing an electron gun according to a third embodiment of the present invention, burrings 330, 331, 333, and 334 of the outer beam passing portion formed on the respective surfaces of first and third accelerating/focusing electrodes 306 and 308, facing a second accelerating/focusing electrode 307, are shorter than burrings 332 and 335 of the central beam passing portion. The voltage Ec2 of accelerating electrode 5 is applied to the second accelerating/focusing electrode 307, and focus voltage Vf is applied to the first and third accelerating/focusing electrodes 306 and 308. An anode voltage Eb is applied to a fourth accelerating/focusing electrode 309.

Figure 10:
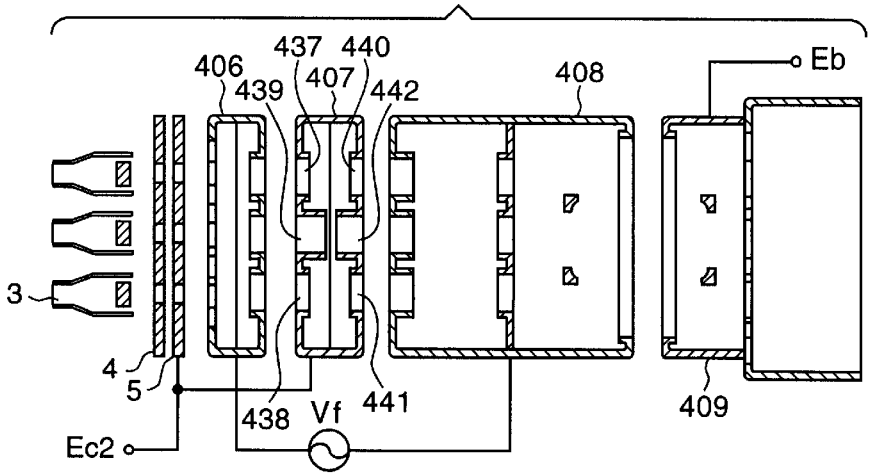
FIG. 10 illustrates an electron gun for a color cathode ray tube according to a fourth embodiment of the present invention.

Referring to FIG. 10 showing an electron gun according to a fourth embodiment of the present invention, burrings 437, 438, 440 and 441 of the outer beam passing portion formed on the electrode surfaces of second accelerating/focusing electrode 407 are shorter than burrings 439 and 442 of the central beam passing portion. The voltage Ec2 of accelerating electrode 5 is applied to the second accelerating/focusing electrode 407, and focus voltage Vf is applied to the first and third accelerating/focusing electrodes 406 and 408. An anode voltage Eb is applied to a fourth accelerating/focusing electrode 409.

Figure 11:
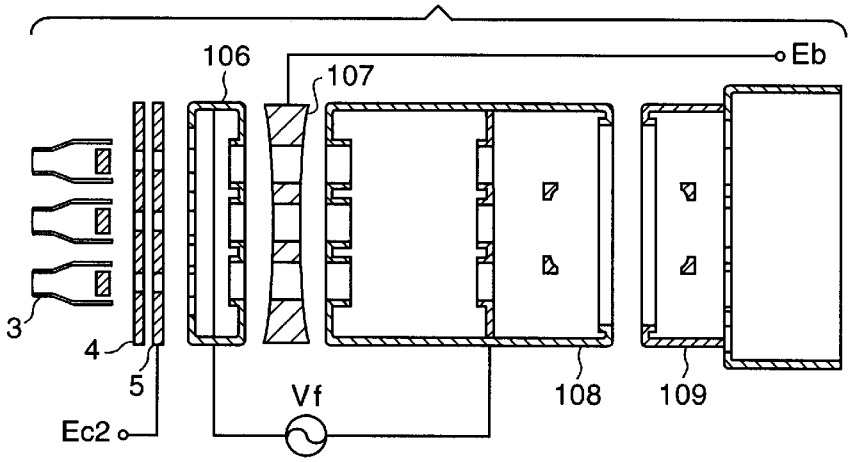
FIG. 11 illustrates an electron gun for a color cathode ray tube according to a fifth embodiment of the present invention.

FIG. 11 shows an electron gun according to a fifth embodiment of the present invention. This embodiment is the same as the first embodiment as shown in FIG. 7, except that an anode voltage Eb is applied to the second accelerating/focusing electrode 107.

Figure 12:
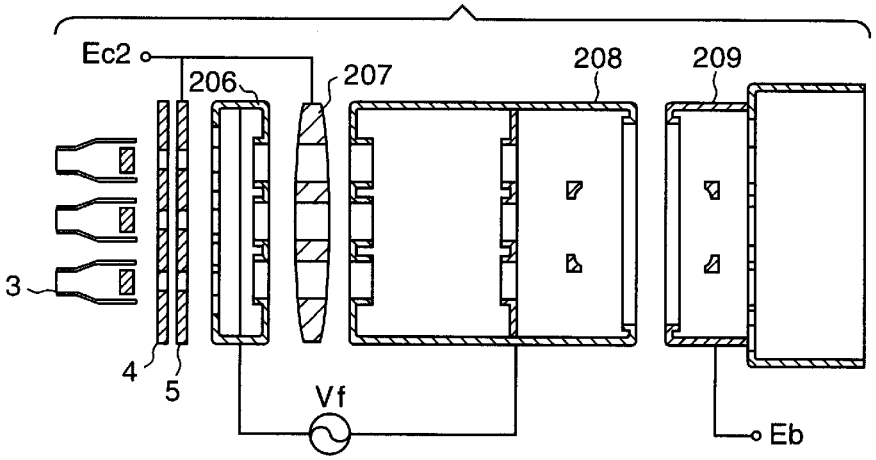
FIG. 12 illustrates an electron gun for a color cathode ray tube according to a sixth embodiment of the present invention.

FIG. 12 shows an electron gun according to a sixth embodiment of the present invention. This embodiment is the same as the second embodiment as shown in FIG. 8, except that an anode voltage Eb is applied to the second accelerating/focusing electrode 207.

Figure 13:
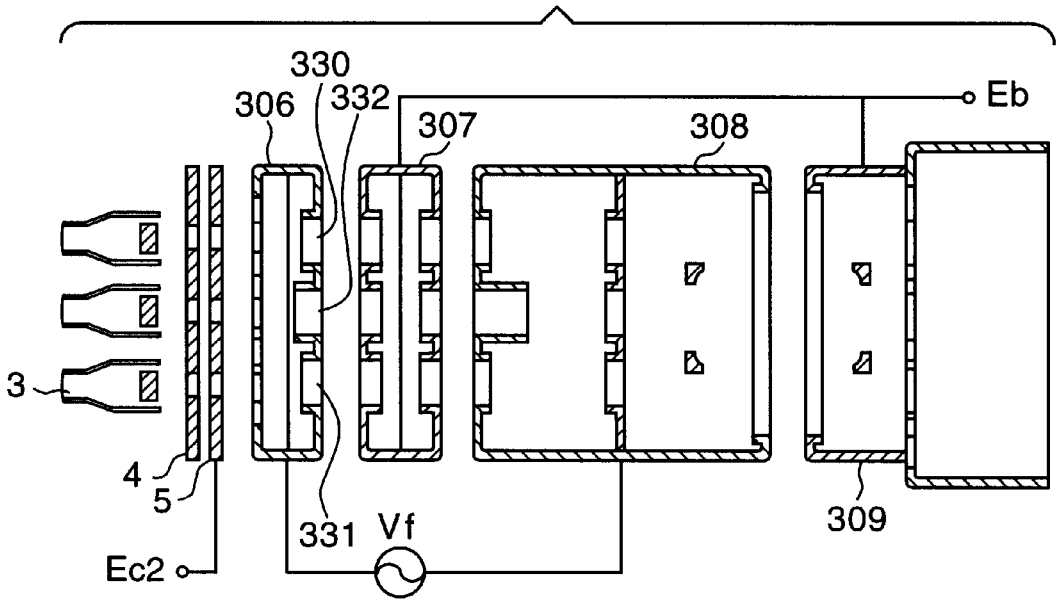
FIG. 13 illustrates an electron gun for a color cathode ray tube according to a seventh embodiment of the present invention.

FIG. 13 shows an electron gun according to a seventh embodiment of the present invention. This embodiment is the same as the third embodiment as shown in FIG. 9, except that an anode voltage Eb is applied to the second accelerating/focusing electrode 307.

Figure 14:
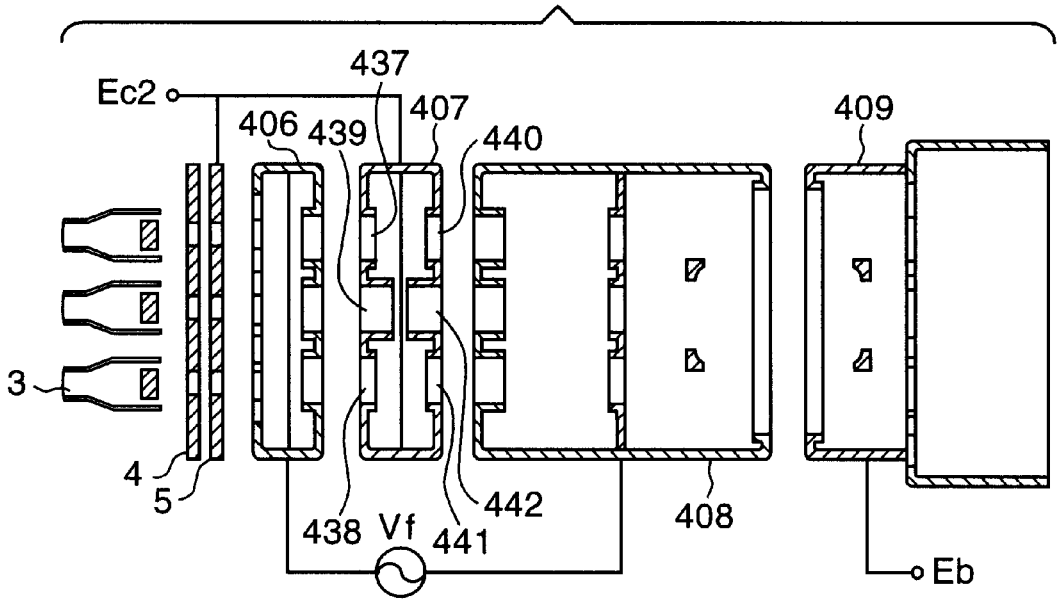
FIG. 14 illustrates an electron gun for a color cathode ray tube according to an eighth embodiment of the present invention.
Figure 15A:
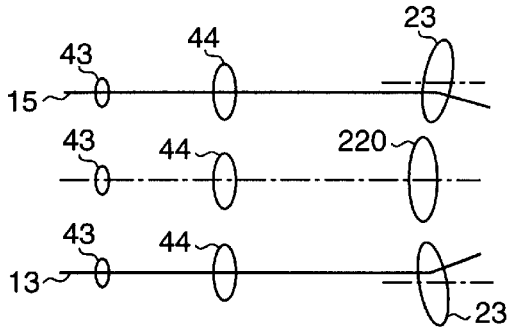
FIG. 15A illustrates the state of lenses of the electron gun for a color cathode ray tube when the center of the outer main lens is inclined in the opposite direction of the central beam.
Figure 15B:
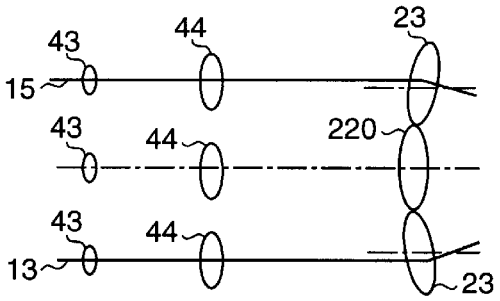
FIG. 15B illustrates the state of lenses for the electron gun for a color cathode ray tube when the center of the outer main lens is inclined in the direction of the central beam.

FIG. 14 shows an electron gun according to an eighth embodiment of the present invention. This embodiment is the same as the fourth embodiment as shown in FIG. 10, except that an anode voltage Eb is applied to the second accelerating/focusing electrode 407.

Figure 1:
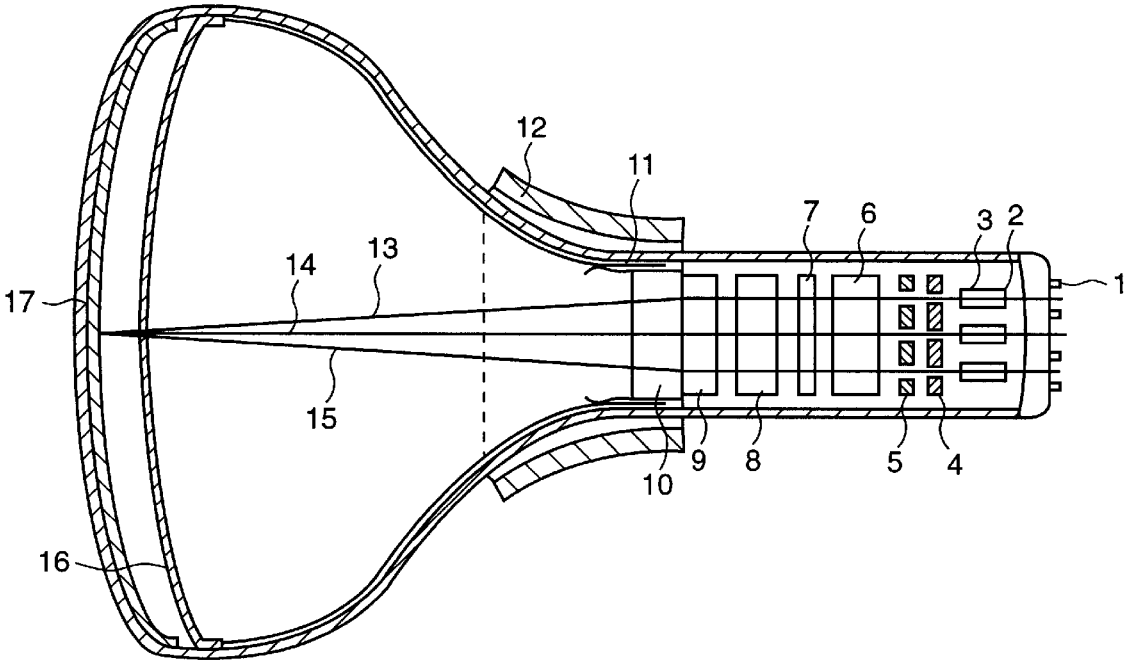
Fig. 1 (PRIOR ART)
FIG. 1 illustrates the structure of a conventional electron gun for a color cathode ray tube.
Figure 2:
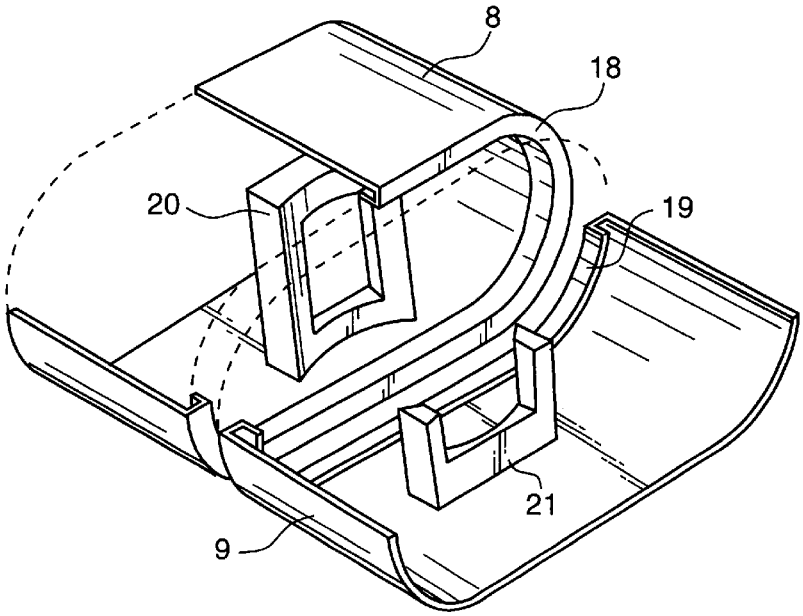
Fig. 2 (PRIOR ART)
FIG. 2 illustrates the internal configuration of a general large-diameter main lens.
Figure 3:
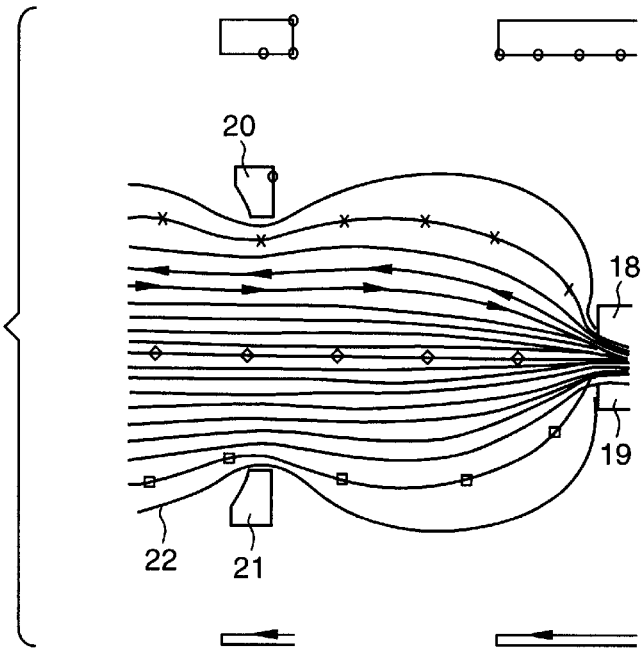
Fig. 3 (PRIOR ART)
FIG. 3 shows the shape of the large-diameter main lens.
Figure 4A:
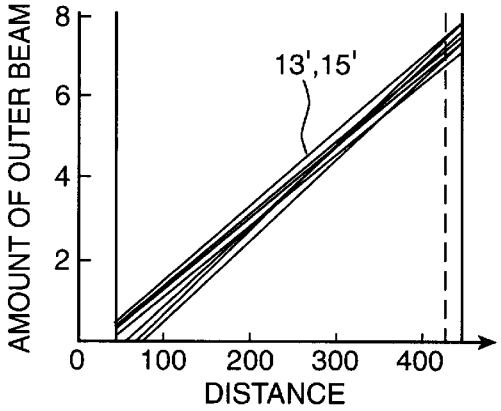
Fig. 4(A) (PRIOR ART)
FIG. 4A is a graph showing the converging degree of outer beams which cannot pass through the center of the large-diameter main lens but advance in the opposite direction of a central beam.
Figure 4B:
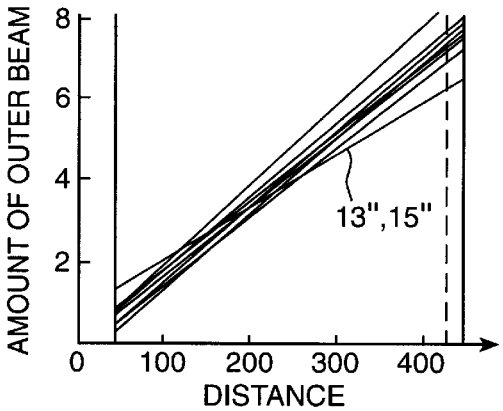
Fig. 4(B) (PRIOR ART)
FIG. 4B is a graph showing the converging degree of the outer beams which cannot pass through the center of the large-diameter main lens but advance in the direction of the central beam.
Figure 5A:
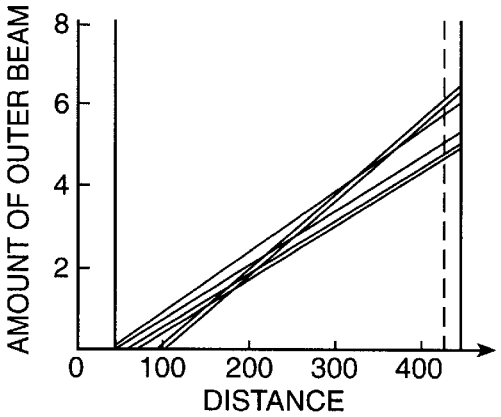
FIG. 5A is a graph showing the converging degree of the outer beams which pass through the center of the large-diameter main lens but advance in the opposite direction of the central beam.
Figure 5B:
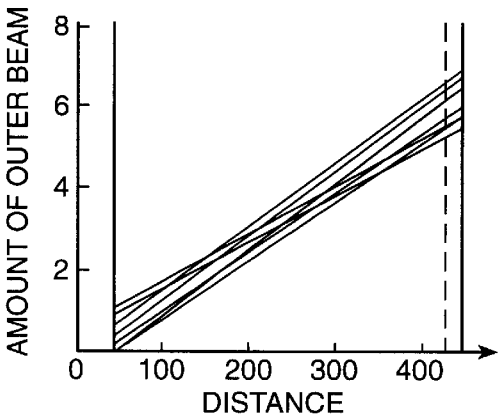
FIG. 5B is a graph showing the converging degree of the outer beams which pass through the center of the large-diameter main lens but advance in the direction of the central beam.
Figure 6A:
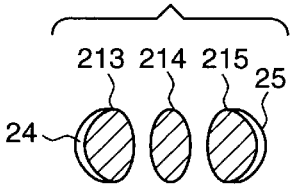
Fig. 6(A) (PRIOR ART)
FIG. 6A illustrates shapes of electron beams when they do not pass through the center of the large-diameter main lens.
Figure 6B:
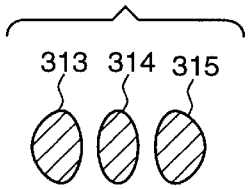
Fig. 6(B) (PRIOR ART)
FIG. 6B illustrates shapes of electron beams when they pass through the center of the large-diameter main lens.
Figure 16A:
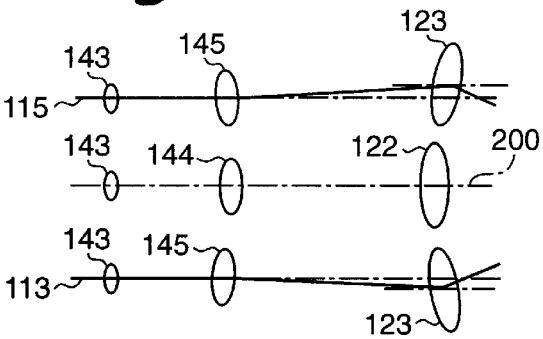
FIG. 16A illustrates the state of lenses of the electron gun for a color cathode ray tube of the present invention when the center of the outer main lens is inclined more in the opposite direction of the central beam from the outer electron beam passing center.

In the first through fourth embodiments of the present invention, in order to compensate for the situation in which the center of each outer lens 123 of a large-diameter main lens (composed of lenses 122 and 123) does not coincide with the center of an outer electron beam passing through a pre-focusing lens 145, outer main lens 123 is inclined so that its center is positioned outside of the center of the outer electron beam path, as shown in FIG. 16A. Each outer pre-focus lens 145 among pre-focus lenses 144 and 145 which are formed in the first, second and third accelerating/focusing electrodes, is inclined in the direction of the central beam 200 so that outer electron beams 113 and 115 pass through the centers of outer main lenses 123 after passing through the outer pre-focus lenses 145. According to this procedure, electron beam spots 313, 314 and 315 are formed as shown in FIG. 6B.

Figure 16B:
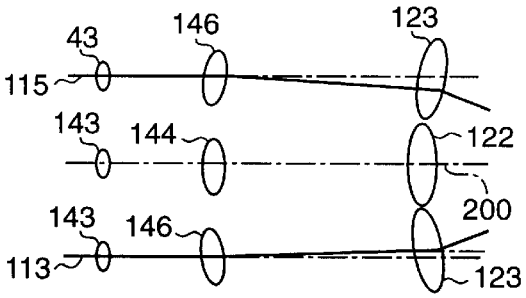
FIG. 16B illustrates the state of lenses of the electron gun for a color cathode ray tube of the present invention when the center of the outer main lens is inclined more in the direction of the central beam from the outer electron beam passing center.

In the fifth–eighth embodiments of the present invention, each outer main lens 123 is inclined so that centers of the outer main lenses 123 are positioned between the outer electron beam paths, as shown in FIG. 16B. By doing so, the outer pre-focus lens 146 among pre-focus lenses 144 and 146 which are formed in the first, second and third accelerating/focusing electrodes, is inclined in the opposite direction of the central beam 200 so that the outer electron beams 113 and 115 pass through the centers of outer main lenses 123. In this case, electron beam spots 313, 314 and 315 are formed as shown in FIG. 6B.

Figure 16C:
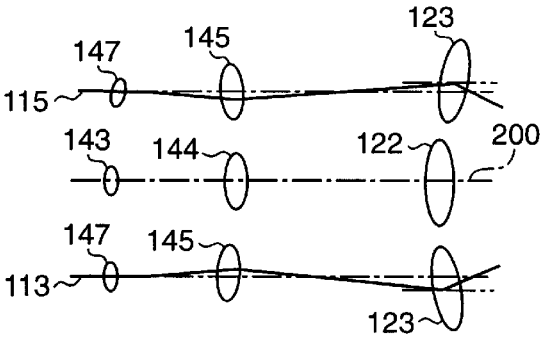
FIG. 16C illustrates the state of lenses of the electron gun for a color cathode ray tube of the present invention when an outer triode lens is inclined in the direction of the central beam.

As shown in FIG. 16C, an outer triode auxiliary lens 147 is inclined in the opposite direction of the central beam 200 in order to alleviate the STC (Static Convergence) phenomenon in the main lens 123. The STC phenomenon refers to a condition where three electron beams are focused on a central portion of the screen without deflections by a deflection yoke. The electron beams pass through the inclined centers of the main lenses 145 and are incident on the main lenses 123 inclined in the opposite direction of the central beam 200. The pre-focus lenses 145 are inclined in the direction of the central beam 200.

Figure 16D:
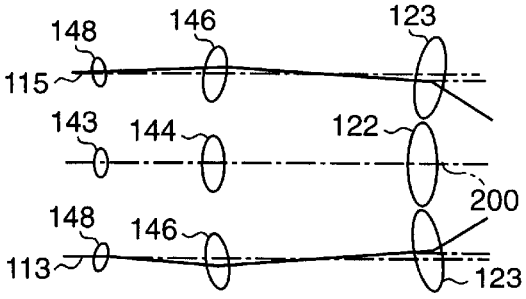
FIG. 16D illustrates the state of lenses of the electron gun for a color cathode ray tube of the present invention when the outer triode lens is inclined in the opposite direction of the central beam.

As shown in FIG. 16D, an outer triode auxiliary lens 148 is inclined in the an direction of the central beam 200 in order to reinforce the STC phenomenon in the main lenses 123. The electron beams pass through the inclined centers of the auxiliary lenses 146 and are incident on the main lenses 123 inclined in the opposite direction of the central beam 200. The auxiliary lenses 146 are positioned in the opposite direction of the central beam 200. In FIGS. 16A–16D, the reference numeral 143 depicts center and outer triode auxiliary lenses.

In order to incline the triode lens, a distance between a central portion of the accelerating electrode and a central portion of the accelerating/focusing electrode, and distances between side portions of the accelerating electrode and side portions of the accelerating/focusing electrodes are made different.

As described above, according to the embodiments of the present invention, the outer front lens is inclined so that the outer electron beam passes through the center of the outer main lens. This eliminates the offset between the center of the outer main lens and the outer electron beam passing center, and any halos distorted due to the concentration of the electron beams. Furthermore, the present invention controls the intensity of the STC phenomenon to thereby enhance resolution.

What is claimed is:

1. An electron gun for a color cathode ray tube, comprising:

a cathode for emitting an electron beam;

a triode portion having a control electrode and an accelerating electrode for controlling an emission amount of the electron beam;

a pre-focus lens formed by a first accelerating and focusing electrode, a second focusing electrode, and a third accelerating and focusing electrode for focusing the electron beam output from the triode portion, the second focusing electrode having at least one curved surface; and at least one main lens formed by said third accelerating and focusing electrode and a fourth accelerating and focusing electrode for focusing the electron beam passed through the first, second and third electrodes of the pre-focus lens on a screen, said at least one main lens including a central main lens and outer main lenses formed on the sides of the central main lens;

wherein at least one of said pre-focus lens and triode portion is formed to incline toward the direction of a center of another main lens so that outer electron beams pass through centers of the outer main lenses formed on the sides of the central main lens.

2. An electron gun for a color cathode ray tube as claimed in claim 1, wherein the center of an outer electron beam passing hole facing the first accelerating and focusing electrode does not coincide with an outer electron beam passing center, so that an outer lens of the triode portion is inclined.

3. An electron gun for a color cathode ray tube as claimed in claim 1, wherein a distance between an outer electron beam passing portion of the accelerating electrode and an outer electron beam passing portion of the first accelerating and focusing electrode facing said accelerating electrode and a distance between a central electron beam passing portion of said accelerating electrode and a central electron beam passing portion of said first accelerating and focusing electrode facing said accelerating electrode are different from each other, so that the outer lens of the triode portion is inclined.

4. An electron gun for a color cathode ray tube as claimed in claim 1, wherein the center of an outer electron beam passing hole facing the first accelerating and focusing electrode does not coincide with the center of an outer electron beam passing therethrough, and said second focusing electrode has a thickness increasing from a central beam passing portion to the outer beam passing portion so that said pre-focus lens is inclined in the direction of the center of the outer lens.

5. An electron gun for a color cathode ray tube as claimed in claim 1, wherein the center of an outer electron beam passing hole facing the first accelerating and focusing electrode does not coincide with the center of an outer electron beam passing therethrough, and said second focusing electrode has a thickness decreasing from a central beam passing portion to the outer beam passing portion so that said pre-focus lens is inclined in the direction of the center of the outer lens.

6. An electron gun for a color cathode ray tube as claimed in claim 1, wherein said pre-focus lens is formed to incline toward the direction of the center of another main lens.

7. An electron gun for a color cathode ray tube as claimed in claim 1, wherein said at least one curved surface of the second focusing electrode of the pre-focus lens includes two curved surfaces formed on the opposite sides of the second focusing electrode.

8. An electron gun for a color cathode ray tube as claimed in claim 7, wherein the two curved surfaces are symmetrical to each other.

9. An electron gun for a color cathode ray tube as claimed in claim 8, wherein the two curved surfaces are convex facing each other.

10. An electron gun for a color cathode ray tube as claimed in claim 8, wherein the two curved surfaces are concave facing each other.

* * * * *